US008857947B2

(12) United States Patent
Belbeck

(10) Patent No.: US 8,857,947 B2
(45) Date of Patent: Oct. 14, 2014

(54) APPARATUS AND METHOD FOR PAPER POSITION SENSING USING TRANSPARENT TRANSPORT BELT

(75) Inventor: Jeffrey Belbeck, Mississauga (CA)

(73) Assignee: Delphax Technologies Inc., Bloomington, MN (US)

( * ) Notice: Subject to any disclaimer, the term of this patent is extended or adjusted under 35 U.S.C. 154(b) by 141 days.

(21) Appl. No.: 13/455,359

(22) Filed: Apr. 25, 2012

(65) Prior Publication Data

US 2013/0201246 A1 Aug. 8, 2013

Related U.S. Application Data

(63) Continuation-in-part of application No. 13/368,280, filed on Feb. 7, 2012.

(51) Int. Cl.
*B41J 29/393* (2006.01)
*B41J 29/38* (2006.01)

(52) U.S. Cl.
USPC ..... 347/19; 347/16

(58) Field of Classification Search
USPC ..... 347/16.19, 16, 19
See application file for complete search history.

(56) References Cited

U.S. PATENT DOCUMENTS

| | | | | |
|---|---|---|---|---|
| 6,079,814 | A | 6/2000 | Lean et al. | |
| 7,665,818 | B2 * | 2/2010 | Yoshida | 347/16 |
| 7,812,735 | B2 * | 10/2010 | Kahl et al. | 340/676 |
| 2001/0028381 | A1 | 10/2001 | Kashiwagi et al. | |
| 2005/0201808 | A1 * | 9/2005 | Barry et al. | 400/679 |
| 2007/0235921 | A1 * | 10/2007 | Schalk et al. | 271/242 |
| 2007/0268351 | A1 | 11/2007 | Ageishi | |
| 2012/0107004 | A1 * | 5/2012 | Sonohara et al. | 399/69 |

* cited by examiner

*Primary Examiner* — Sarah Al Hashimi
(74) *Attorney, Agent, or Firm* — Stuart L. Wilkinson

(57) ABSTRACT

A printing apparatus has a print head and a transport mechanism including a continuous transparent belt for transporting a sheet medium past a print head. The apparatus includes a through optical sensor operable to direct a sensing beam through the belt for sensing the position of the transported sheet medium when the sheet medium breaks the beam.

19 Claims, 8 Drawing Sheets

APPARATUS AND METHOD FOR PAPER POSITION SENSING USING TRANSPARENT TRANSPORT BELT

CROSS REFERENCE TO RELATED PATENTS

The present United States Utility patent application claims priority pursuant to 35 U.S.C.§120, as a continuation-in-part to copending U.S. patent application Ser. No. 13/368,280, entitled "MULTIPLE PRINT HEAD PRINTING APPARATUS AND METHOD OF OPERATION", filed Feb. 7, 2012, the contents of which are hereby incorporated by reference in their entirety and made part of the present United States Patent Application for all purposes.

FIELD OF THE INVENTION

This invention relates to a multiple print head printing apparatus and method of operation and has particular application for transporting sheet media to print zones in such a printer.

DESCRIPTION OF RELATED ART

There is a need for inkjet printers with multiple print heads. Multiple print heads may be required in the transport direction for achieving high sheet processing speeds, printing an image on a sheet with a large number of inks, and printing characters with a greater ink thickness, and therefore colour density or magnetic ink character recognition (MICR) signal strength, than can be achieved with a single print head. Multiple print heads may also be required extending transverse of a direction of paper transport in order to allow printing of an image having a width greater than can be achieved using a single commercially available print head.

With multiple print heads in the transport direction, it may be required that an image printed at a first print head is in exact registration with an image printed at a subsequent print head so that a combined image is achieved. If there is even a slight movement of the print medium, whether arising, for example, from translational movement in the transport or transverse direction, or from the print medium sheet being skewed as it is transferred between the two print heads, then the combined image will be degraded or distorted. The use of an array of multiple inkjet printer heads to create a single combined image where ink from one print head must be precisely positioned in relation to ink from another print head places particular demands on apparatus for transporting sheet media from one print head to another.

Problem-free paper transport arrangements for printers are difficult to achieve especially for individual sheets. Problems that can arise variously with different types of sheet transport arrangement include paper jams, skewed or translationally misplaced images, and lifting or curling of paper away from an underlying platen or belt forming part of the sheet feed arrangement. Many transport systems and methods are known for moving a sheet of paper from an input zone, through a print zone, to an output zone. Generally, such transport systems have a drive arrangement for moving the sheet forward through the zones and a holding means for temporarily holding the sheet to an element of the drive arrangement such as a belt or platen. Well-known sheet transport systems for printers include vacuum systems and roller nips.

A known vacuum system includes a belt to which paper sheets are fed in an orderly sequence at an input zone and from which printed sheets are taken at an output zone. The belt has perforations throughout its length and is driven over an opening to an adjacent air plenum in which a partial vacuum is maintained during the sheet feeding process. The vacuum acts through the perforated belt to suck the paper sheets against the belt. The belt is driven around a roller system to take the vacuum tacked paper sheet from the input zone, past the print zone, to the output zone.

Co-pending patent application Ser. No. 13/368,280 describes a system having a continuous belt of a highly dielectric material for transporting a sheet medium supported on the belt in the transport direction for printing partial images thereon successively by the respective print heads, a charging means to charge the sheet medium to electrostatically tack the sheet medium to the belt, a positioning subsystem to position the belt relative to the print heads, and a control module to coordinate operation of the positioning sub-system with operation of the print heads whereby to obtain a combined image comprising a first partial image printed by a first print head in registration with a second partial image printed by a second print head.

In such belt transport systems, whether using vacuum tacking, electrostatic tacking, or some other method of anchoring a sheet medium to the belt as it is transported past successive print heads, it is important to know accurately the position of media sheets as it is transported from a position where it is launched onto the belt to a position where it exits the equipment. It is important to know exactly where the sheet medium is in order to fire appropriate jets of the inkjet print heads at the right time for obtaining partial images that are accurately registered with each other. And it is equally important to know when a sheet medium does not appear when it is expected to as this may be evidence of a paper jam.

In such copending application, there is described one method for tacking the position of a sheet medium. A leading edge of a sheet medium is sensed by an optical sensor immediately before it is launched onto the belt to be transported by the belt. The movement of the sheet medium is then tracked to ensure it appears when is expected to at each of the successive printing stations. In addition, the movement of the belt is measured in order to compute how far the sheet medium has travelled since it was detected on being launched onto the belt. The measured travel is used to coordinate the firing of ink jets. Methods and apparatus are desirable for accurately tracking the transport of sheet media on a belt.

SUMMARY OF THE INVENTION

According to one aspect of the invention, there is provided a printer having a print head, a transport mechanism comprising a continuous belt for transporting a sheet medium supported on and retained substantially in a fixed position relative to the belt during transport by the belt in a transport direction for printing an image thereon by the print head, the belt being at least partially transparent, and a series of through beam optical sensors operable to direct a sensing beam through the belt for sensing of the position of the transported sheet medium upon the sheet medium breaking the beam.

BRIEF DESCRIPTION OF THE DRAWINGS

For simplicity and clarity of illustration, elements illustrated in the following figures are not drawn to common scale. For example, the dimensions of some of the elements are exaggerated relative to other elements for clarity. Advantages, features and characteristics of the present invention, as well as methods, operation and functions of related elements of structure, and the combinations of parts and economies of manufacture, will become apparent upon consideration of the following description and claims with reference to the accompanying drawings, all of which form a part of the specification, wherein like reference numerals designate corresponding parts in the various figures, and wherein:

DETAILED DESCRIPTION OF THE INVENTION INCLUDING THE PRESENTLY PREFERRED EMBODIMENTS

Figure 1:
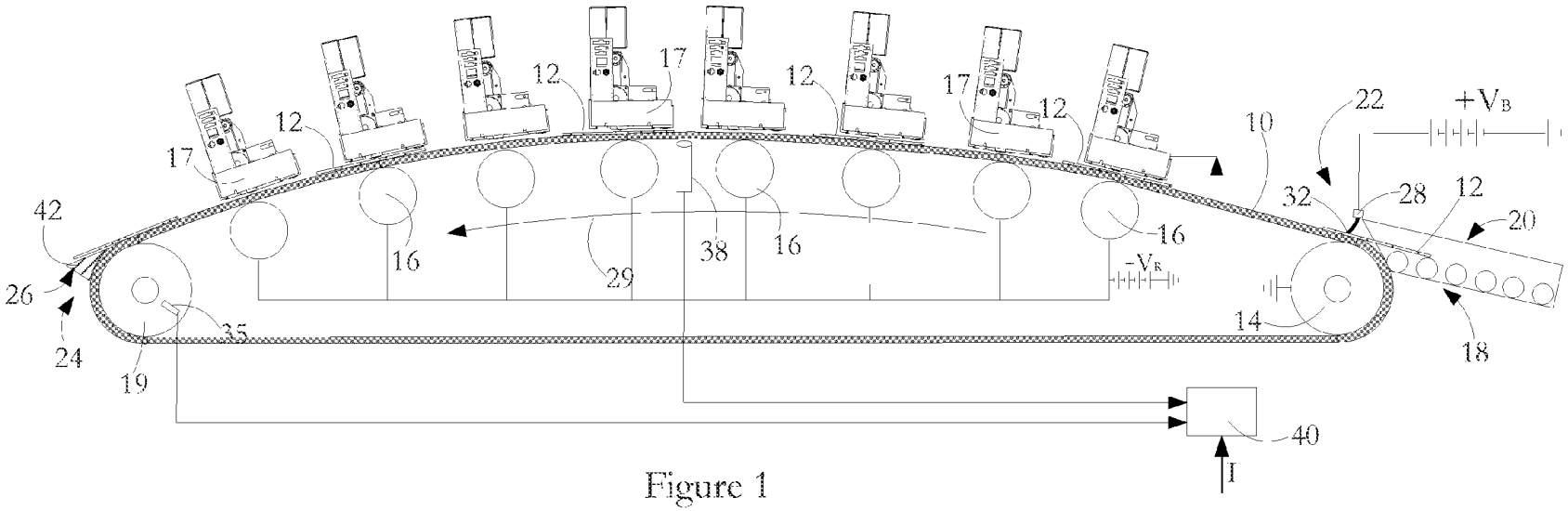
FIG. 1 is a side view of an inkjet printer sheet feed arrangement according to an embodiment of the invention.
Figure 2:
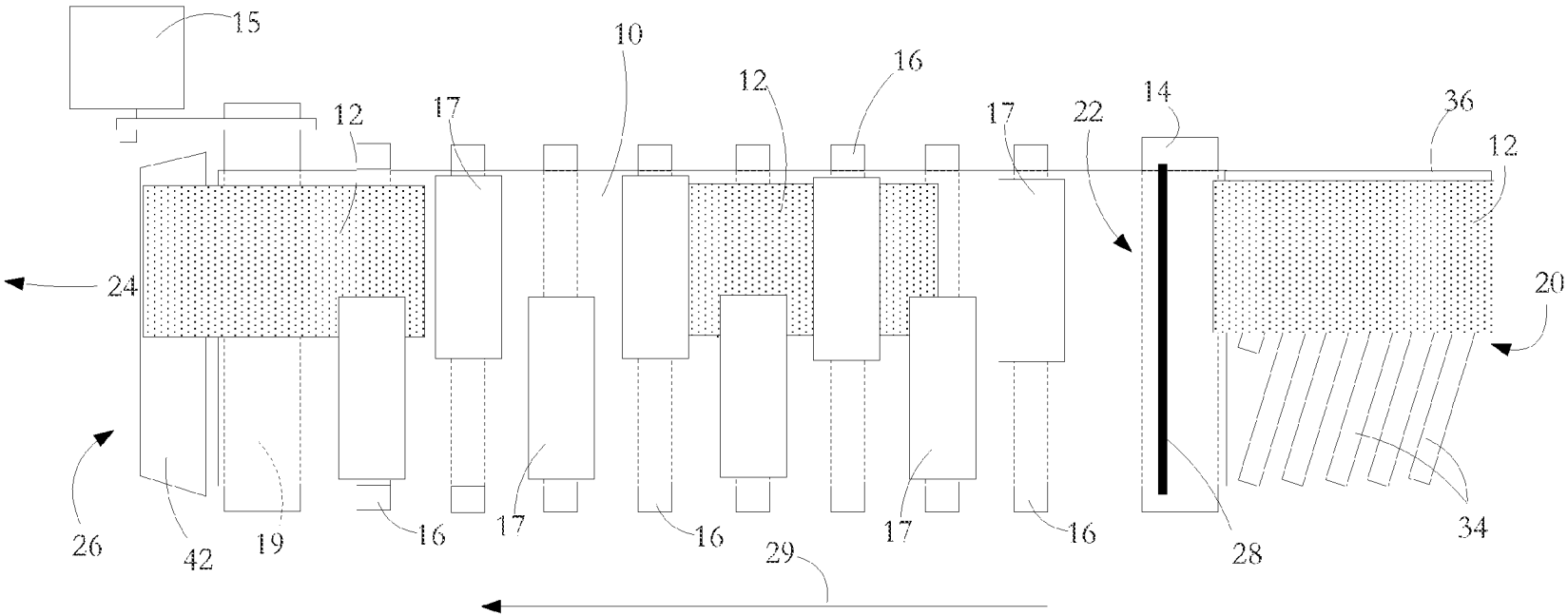
FIG. 2 is a top view of the arrangement of FIG. 1.

Referring in detail to FIG. 1, there is shown a continuous belt 10 for transporting paper sheets 12, the belt being driven by a drive roller 19 around a series of idler rollers 16. At an input zone, shown generally as 18, there is a paper alignment sub-system 20 and a charge transfer sub-system 22. At an output zone shown generally as 24, is a paper sheet stripper arrangement 26. Each of the idler rollers 16 is located adjacent a corresponding inkjet print engine 17. Each print engine 17 contains an inkjet print head 13 and mechanical, electrical and fluidic hardware needed to position and operate the print head. The belt is made of Mylar®, an electrical insulator having a high dielectric strength, the belt having a thickness of the order of 0.13 millimeters. While other belt materials are envisioned, Mylar® is particularly suitable owing to its strength, stiffness, transparency, dielectric strength and low leakage. As shown in FIGS. 1 and 2, the inkjet print engine array comprises eight print engines arranged in two staggered banks of four print engines. As shown in the side view, the print engines of each bank are arranged in a wide diameter arc with each print engine facing the belt where the belt 10 passes over an associated idler roller 16. The idler rollers 16 are maintained at a negative voltage $V_R$ for reasons to be described presently. On the face of each print head 13 are nozzles having exit openings that are spaced from the upper surface of the belt by ½ to 1 millimeter. By tensioning the continuous belt 10 over the arcuate arrangement of rollers 16, the print head to belt spacing is maintained at a comparatively unvarying distance.

As is well-known, inkjet printers operate by ejecting droplets of ink onto a web or sheet medium. Such printers have print heads that are non-contact heads with ink being transferred during the printing process as minute "flying" ink droplets over a short distance of the order of ½ to 1 millimeter. Modern inkjet printers are generally of the continuous type or the drop-on-demand type. In the continuous type, ink is pumped along conduits from ink reservoirs to nozzles. The ink is subjected to vibration to break the ink stream into droplets, with the droplets being charged so that they can be controllably deflected in an applied electric field. In a thermal drop-on-demand type, a small volume of ink is subjected to rapid heating to form a vapour bubble which expels a corresponding droplet of ink. In piezoelectric drop-on-demand printers, a voltage is applied to change the shape of a piezoelectric material and so generate a pressure pulse in the ink and force a droplet from the nozzle. Of particular interest in the context of the present invention are thermal drop-on-demand inkjet print heads commercially available from Silverbrook Research, these being sold under the Memjet trade name which have a very high nozzle density, page wide array and of the order of five channels per print head. Such inkjet print heads have a very high resolution of the order of 1600 dots per inch.

The charge transfer sub-system 22 includes an elongate brush 28 extending transverse to the feed direction. The brush has a series of conducting bristles 30 which are fixed at their upper ends into a conducting housing and which have their lower ends in contact with or close to the upper surface of the paper sheets as they are fed onto the belt 10 at the sheet input zone 18. If the bristles contact paper sheets 12 at the sheet input zone, contact pressure is kept sufficiently low that the sheets are neither damaged nor displaced by the contact. The brush 28 is located close to a grounded conductive roller 14 underlying the belt. The sheets are fed onto the belt by an upstream feed arrangement to be described presently.

In operation, the belt is driven by the roller 19 from a motor 15. The belt tracks around the idler rollers 16 and 14. A potential $V_B$ in the range of +1000 volts to +5000 volts is applied to the brush 28. As a paper sheet 12 is transported by the belt past by the brush 28, charge is transferred from bristle tips 32 to the sheet. The sheet is charged positive and a counter negative charge develops on the underside of the belt owing to the presence of the grounded roller 14. The positive charge on the paper sheets 12, in effect, causes the sheets to be electrostatically "tacked" to the belt. While the exact dynamics of charge transfer to the paper sheets 12 are not fully understood, it is believed that there is at least an element of corona discharge around the tips 32 of the bristles where an intense electric field gradient causes ionization of the air with consequent current passing from the brush to the top surface of the belt. This may be compounded by a triboelectric effect in which charge remains on the paper sheets as contact between such sheets and the bristle tips are broken owing to movement of the belt around the roller system. The highly dielectric nature of the material of the Mylar belt means that charge on the paper sheets 12 does not leak away as the sheets are transported from the input zone to the output zone.

Figure 3:
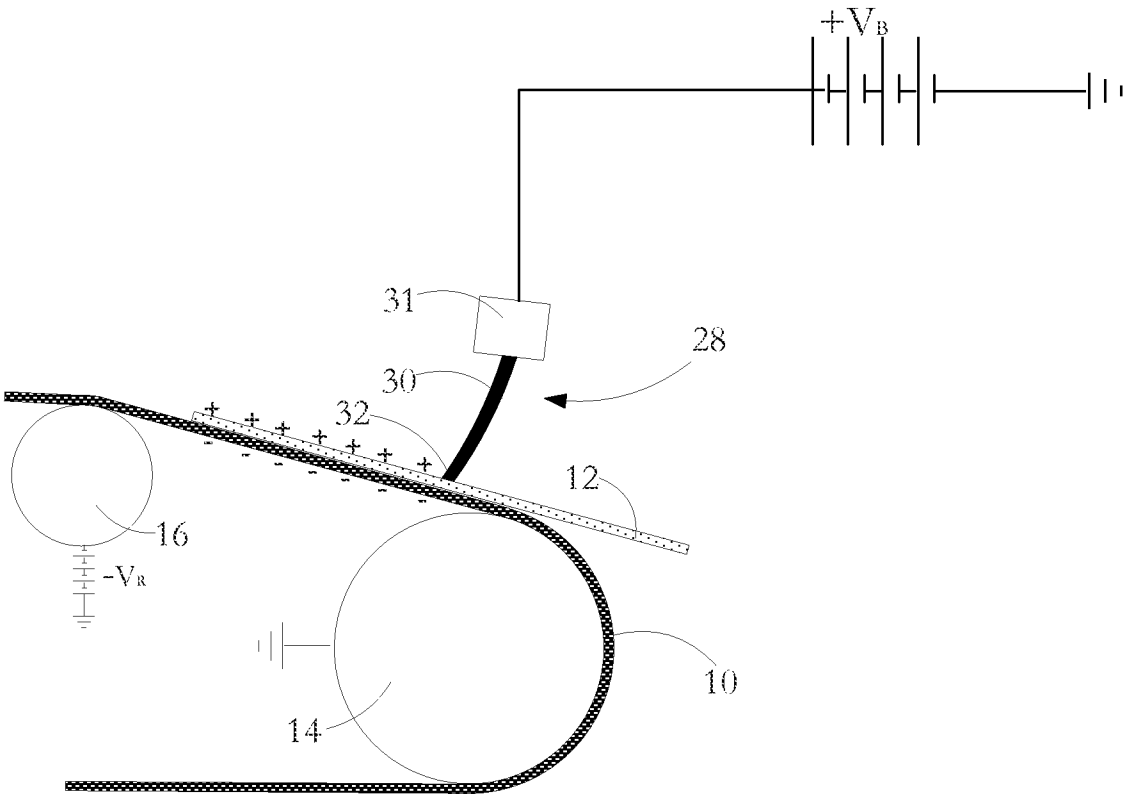
FIG. 3 is a view to a larger scale of a part of the arrangement of FIG. 1 showing a charge transfer brush and its interaction with paper sheets being fed onto a continuous belt for transport past an array of inkjet print heads.
Figure 4:
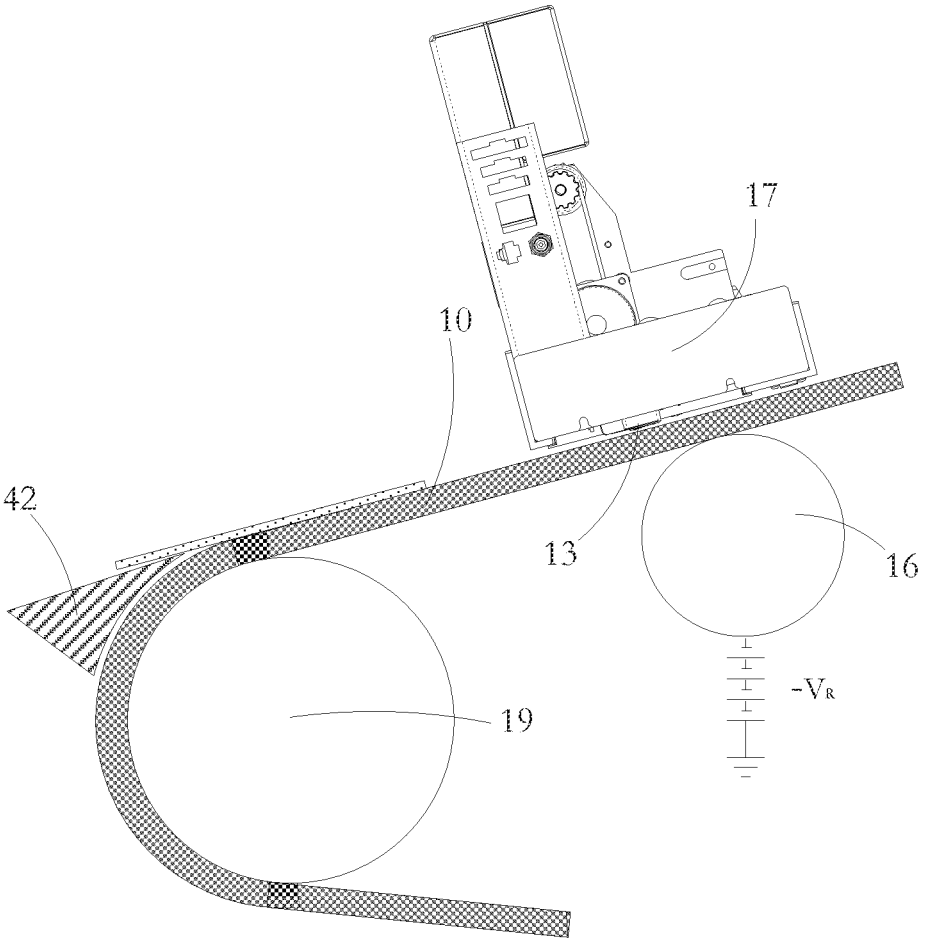
FIG. 4 is a view to a larger scale of a part of the arrangement of FIG. 1 showing a stripper arrangement for stripping an electrostatically tacked paper sheet from a feed belt after a printing process has been completed.

As shown in the scrap view of FIG. 3, the opposite polarity charges—the negative charge at the reverse side of the belt and the positive charge on the paper sheets—set up an attraction which causes the paper sheet to bear against the top surface of the belt. In effect, the paper sheets 12 become electrostatically tacked to the belt.

The paper alignment sub-system 20 is used for initially aligning sheets entering the input zone to a datum and can take any of a number of known forms. The arrangement shown in FIG. 2 has a series of alignment rollers 34 having non-smooth bearing surfaces, the alignment rollers mounted at an angle to the sheet feed direction and a fence 36 aligned with the feed direction. Rectangular paper sheets 12 are transferred into the alignment sub-system generally in an orientation in which they are to pass through the print zones. The inclined rollers 34 are rotated so that a frictional contact between the surfaces of the alignment rollers and the sheets 12 drives the sheets against the fence 36 to more accurately align the sheets with the feed direction. While still under the alignment control of the sub-system 20, leading parts of the sheets pass under the brush 28 and are electrostatically tacked in the then-current position. Other types of feed mechanism for launching sheet media onto the belt may alternatively be used such as a conventional notched wheel driver, the notched wheel having fingers orientated and stiff enough to drive sheets against an alignment edge but sufficiently flexible not to scuff or otherwise damage the sheet media. It will be appreciated that other methods for alignment of sheet media can be used.

The paper alignment sub-system 20 is supplemented by a tracking sub-system which tracks the movement of sheets through the print zone. To ensure accurate positioning of the image on the sheets in the transport direction, the leading edge of each sheet is first detected before the sheet reaches the first print engine in the print engine array. Following this first detection, only the motion of the belt, as accurately measured by a shaft encoder 35 mounted on the belt drive, is used for tracking. Because each sheet is electrostatically tacked to the belt, accurate tracking of the sheets is ensured. Tracking signals from the shaft encoder 35 form inputs to a control module 40, the control module also having an input I comprising the image data for images or partial images to be printed by each of the print engines 17. The control module 40 has outputs (one of which is shown) to each of the print heads which instructs which nozzles of each print head are to be fired and the instant at which each such nozzle is to be fired. The instant of firing of each nozzle is made to depend on the tracking data for that nozzle so that partial images from successive print heads which are to be combined as a single image are in precise registration.

In relation to transverse control, any excursion of the belt in a transverse direction as it is driven through the print zone is monitored by an optical sensor 38 and, based on the sensor output, the idler roller 14 is adjusted to maintain the transverse position of the belt constant to within an acceptably small tolerance. Note that even if accurate initial alignment of sheets is not completely achieved at the sub-system 20 resulting in the sheet having a transverse offset or skew, because the sheet is tacked to the belt, any such offset or skew is unchanged as the sheet is presented to each print engine 17 as it is transported through the print zone. Consequently, component images are subjected to the same offset or skew as they are printed by successive print heads, resulting in an accurately registered combination image.

Figure 7:
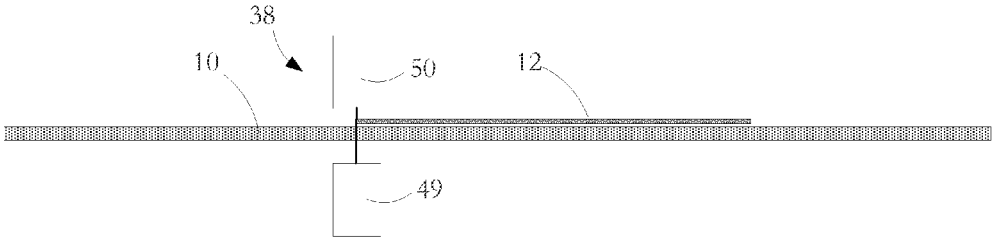
FIG. 7 is a schematic view from one side showing the use of an optical through beam sensor for sheet medium detection according to an embodiment of the invention.
Figure 8:
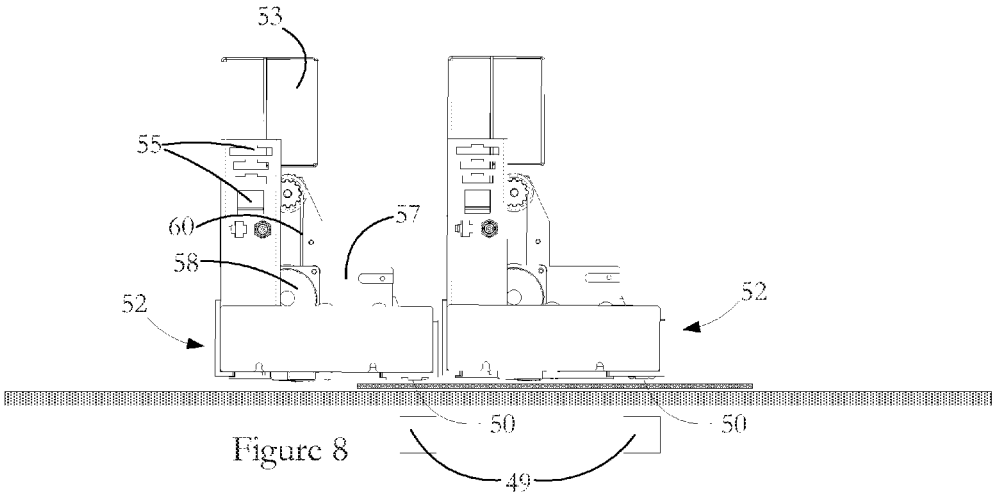
FIG. 8 is a part schematic view from one side of the arrangement of FIG. 7 but showing a pair of the optical through beam sensors and their relationship to two of a pair of print heads.

In an alternative embodiment of the invention as illustrated in FIG. 7, the position of a paper sheet 12 on the belt 10 is determined at spaced locations along the belt by using a transparent Mylar belt and a series of optical sensors 38. If desired for other reasons, a semi-transparent belt may also suffice. The optical sensors 38, one of which is shown in the figure, each have an optical source 49 mounted below the belt 10 and a detector 50 mounted above the belt 10. As shown in FIG. 8, the detector is mounted on a support structure 52 which houses a print head, maintenance units, and ink and electrical supply elements with each of the print heads being supported in a respective one of the support structures 52. At this mounting position, the sensors are approximately half way between print heads of each adjacent pair thereof. In the illustrated embodiment, this spacing is approximately 7 inches in the transport direction. As will presently be described, this enables detection of any paper sheet that is 8 inches or longer in length that is left in the transport apparatus. Clearly, for shorter papers, a different spacing of optical sensors is adopted.

Also mounted in the support structure 52 are a pump motor drive printed circuit assembly 53, connectors 55 (for power, communication, ink delivery system control, waste valve control and vent valve control), a print head lifting mechanism 57 including a stepper motor 58 and belt 60 for lowering and lifting the print head to initiate and terminate printing operations. The sensors 38 are each operable to direct a light beam up through the transparent belt 10 with the light beam being detected if is not blocked by the presence of a paper sheet 12. Clearly, the position of the optical source 49 and the detector 50 can be reversed. The failure of a sensing beam to be broken at one of the sensors 38 when expected arising from previous detected positions of the paper sheet 12 as it is transported by the transparent belt 10 in the transport direction may be indicative of a paper jam. In such an instance, the printing operation is suspended to allow the apparatus to be opened and the paper jam to be cleared. For as long as the paper sheets appear as expected as detected by the optical sensors 38, then the printing operation is allowed to continue.

The use of a through beam sensor 38 is considered to have advantages over reflective sensors which might alternatively be used in a belt transport system for transporting sheet media. With a reflective sensor, the optical source and the detector are on the same side of the paper. The optical source sends a beam of light to the paper sheet, the beam reflects off the paper, and the reflected light is received by the detector. A problem with using reflective sensors is that they may give erroneous results when required to detect the presence of certain media such as pre-printed forms. When using reflective sensors, dark image areas on such forms can reduce reflectivity sufficiently to fool the sensor into thinking there is no paper present when actually it is present. Also, in some circumstances, the detector may not have the setting and/or sensitivity required to distinguish between the belt and sheet media of certain appearances. While some reflective sensors are commercially available that can be tuned to be somewhat insensitive to pre-print and are able to also distinguish between the paper and the background, they are expensive, and therefore not well-suited for the multiple sensor equipment of the type described herein.

Figure 9:
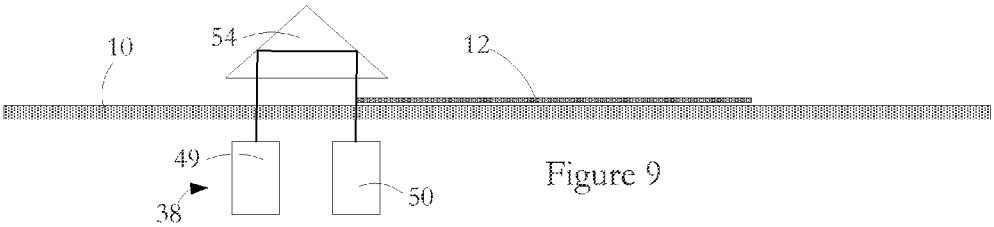
FIG. 9 is a schematic view from one side showing the use of an optical through beam sensor for sheet medium detection according to another embodiment of the invention.
Figure 10:
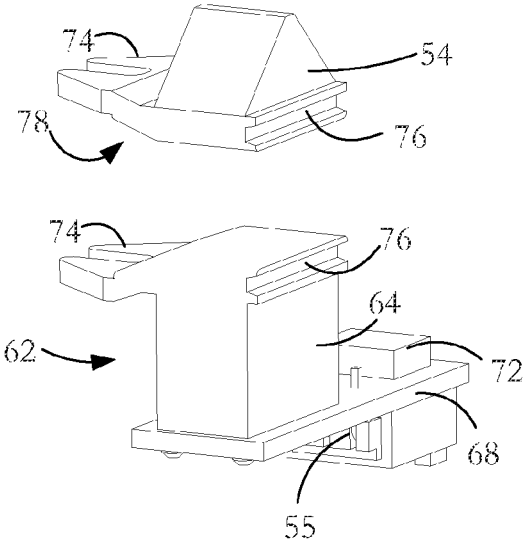
FIG. 10 is a perspective view to a larger scale of an optical through beam sensor of the type used in the FIG. 9 arrangement.
Figure 11:
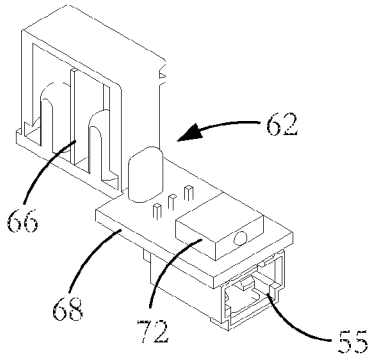
FIG. 11 is a perspective cutaway view showing part of the sensor of FIG. 10.

The use of a different form of through beam sensor is schematically illustrated in FIG. 9 with the sensor itself being shown in the perspective views of FIGS. 10, 11. As shown in FIG. 9, the sensor 38 has an optical source 49 and a detector 50 on the same side of the belt 10. The light beam is directed from the optical source 49 through the belt 10 to a prism reflector 54. At the prism reflector, the beam is reflected back through the belt 10 to the detector 52. The detector 50 is mounted either downstream of the source 49 or laterally adjacent to it. As shown in either the perspective view of FIG. 10 or the cutaway view of FIG. 11, a source/detector unit 62 has both source 49 and detector 50 mounted in a housing 64, with the source and detector separated by an opaque barrier 66 to reduce the risk of spurious detection of stray light. The unit 62 has a printed circuit board 68 through which electrical inputs are taken from input terminals of connectors 55 to the optical source and from which electrical outputs are taken from the detector to output terminals of connectors 55. The source/detector unit 62 includes an LED indicator element 72 to show whether the sensor beam is blocked or unblocked and has a mounting tab 74 and channel member 76 to enable the unit to be mounted in a mounting plate (not shown) having complementary mounting elements. A corresponding reflector unit 78 has a triangular plastic or glass prism 54 and a similar arrangement of mounting tab and channel member 74, 76 for mounting in an aperture within a wall of the print head support structure 52.

Both the FIG. 7 and FIG. 9 forms of optical through beam sensor 38 are configured to decrease the chance of spurious signals arising from reflections at the belt or paper surface. In the case of the FIG. 7 arrangement, the source and detector are vertically aligned to minimize the chance of reflections internal to the belt propagating to the detector. In the case of the FIG. 9 arrangement, the optical source and detector are parallel and spaced sufficiently apart that any significant reflection from the surface of the belt 10 and/or the surface of paper sheet 12 is not detected at the detector.

Figure 12:
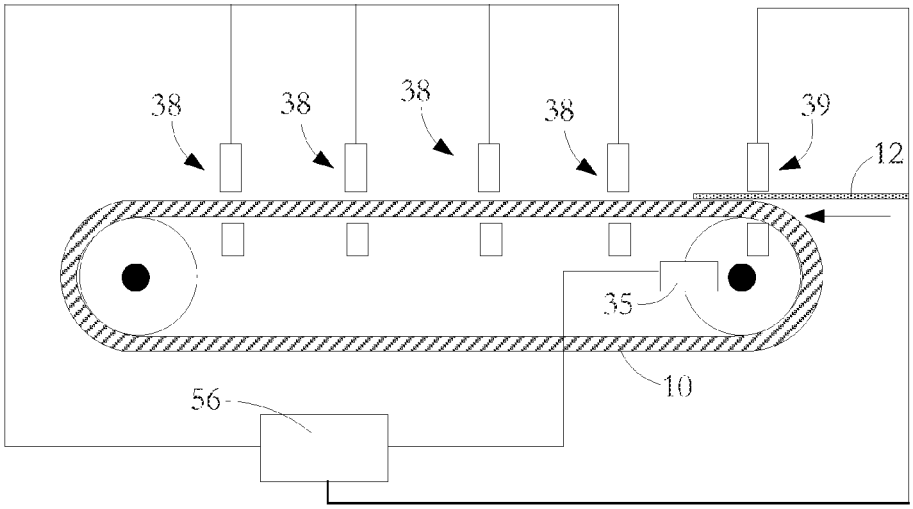
FIG. 12 is a part schematic, part side view to demonstrate the use of optical through beam sensors for certain printer operations.
Figure 13:
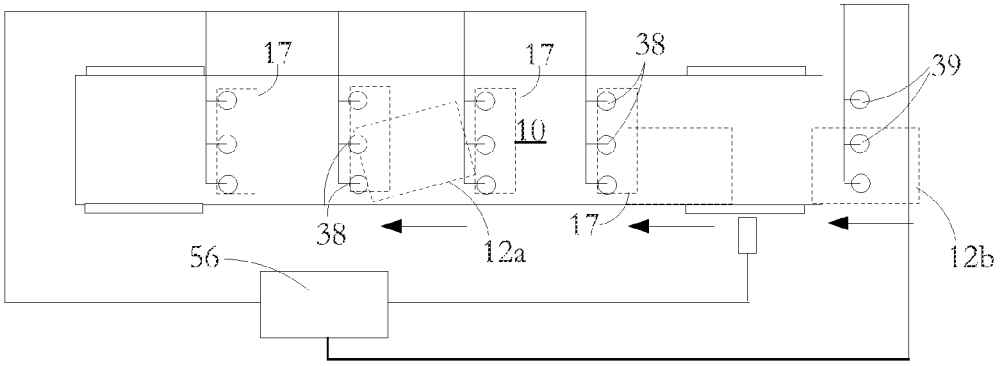
FIG. 13 is a part schematic plan view corresponding to FIG. 12.

As previously indicated, an optical sensor 38 is associated with each of the print engines and a paper jam is detected by any instance of the paper sheet 12 not appearing at a print station when it is expected to, based on its prior travel through the printing apparatus. As shown in FIGS. 12 and 13, a signal from each of the optical sensors 38 associated with each of the print engines is taken to a signal processing unit 56 and is used to identify possible paper jams. A second input signal is taken from an optical sensor 39 which is mounted adjacent a position at which paper sheets 12 are launched onto and tacked to the belt 10, and a third signal is taken from shaft encoder 35. The second and third signals are processed at the signal processing unit to detect the passage of the leading edge of a paper sheet 12 as it is launched past the sensor 39 and then to monitor the movement of the belt 10 as detected by the shaft encoder. Consequent on computing the exact position of the paper sheet 12 from processing these two signals, the firing of jets at successive print heads 17 is synchronized to achieve accurately registered partial images.

As shown in the plan view of FIG. 13, at each printing head 17 and at the site of paper launch onto the belt, there are a number of optical sensors arrayed transversely of the belt. The transverse arrays permit a number of enhancements in the operation of the printing apparatus. Firstly, a sensor array can be used to detect a paper sheet that is skewed such as the sheet 12*a*. As the skewed sheet 12*a* is transported on the belt 10, the sensing beam of the central sensor 38 in the sensor array is broken before the sensing beam associated with the outlying sensor 38. The timing offset is computed from the signals from the two sensors 38 and is processed with the signal input from the belt shaft encoder 35 to determine the angle of skew. Knowledge of the skew angle can be used to fire inkjet print jets at the print heads 17 to introduce compensation for the skew and so render an image which is not skewed. Alternatively, knowledge of the skew can be used at a later stage to trim sheets in such a way as to hide the skew. Finally, if the skew is detected at launch—i.e. for some reason, a launched paper sheet 12*a* has not registered well as it becomes tacked to the belt—it can be marked for discarding.

Returning to FIG. 1, at the output zone 24, partial stripping of paper sheets 12 from the belt 10 is achieved by using the inherent stiffness of the sheet paper to cause a leading edge portion of a sheet 10 to spring away from the belt 12 as the belt turns through a tight angle at the drive roller 19. Subsequent full stripping of the sheet is achieved by the presence of a stripper bar 42 mounted so that the initially lifted sheet edge portion passes over the top of the bar as the belt passes underneath the bar.

With the invention described, paper sheets are firmly tacked to the belt and so can be accurately transported under the array of inkjet print heads. The multiple print head system can be operated at a very fast sheet processing rate of the order of 700 mm/second or more. Even though multiple overprinted or combined images with highly accurate registration can be achieved using this method, ink deposited on a sheet upper surface is not disturbed as the sheet is transported through successive print zones at the array of print heads.

Generally, accurate transport of sheet media is rendered more difficult if the transport system has to handle papers with a wide range of properties. In terms of surface finish, a sheet may be smooth or rough, and shiny or matt. In terms of thickness and density, the paper may range from tissue paper to card stock. The controllability and accuracy of conventional sheet transport systems, including those described previously, may vary with variation in any or all of these particular sheet paper properties. The apparatus and method described herein can be used effectively with papers and other sheet media having a range of properties, including surface finish, thickness and density.

By electrostatically tacking the paper to the belt, a simplified tracking system can be used which tracks the position and motion of the belt instead of the position and motion of the paper sheets. The belt material is more stable and stiffer than paper. Consequently, it is easier to obtain accurate registration and other handling dynamics over a wider range of papers regardless of paper surface finish, thickness and density.

A potentially adverse effect of maintaining charge on the upper surface of the belt and the induced charge of opposite polarity on the reverse surface of the belt is that contaminants may be attracted to the print heads from the charged paper sheets. This is unwelcome because the contaminants can cause print head nozzles to become blocked. A two stage removal process is utilized. Firstly, contaminants associated with the paper sheets, such as small particulate paper debris, are removed before the sheets are fed to the belt. Such contaminants may, for example, have been introduced during the paper production process and are distributed on the paper surface. Secondly, predominantly air-borne contaminants such as dust are removed from zones surrounding the print heads and the belt before they can settle in the neighbourhood of the print heads and affect the operation of the print head nozzles.

In one exemplary process for paper cleaning, a tacky or polymer roller is run over the paper sheets with the roller periodically being cleaned to detach any build-up of contaminants from the roller surface. This method is supplemented by the use of antistatic ionization bars to neutralize static electricity and reduce cling of debris to the paper surface. In another sheet cleaning method, loose debris is dislodged by means of a brush rotating counter to the paper feed direction, the dislodged debris being immediately subjected to a vacuum to carry the debris away. This method, too, is supplemented by use of the antistatic ionization bars. In yet another method, paper sheets are pre-cleaned with an air knife.

Figure 6:
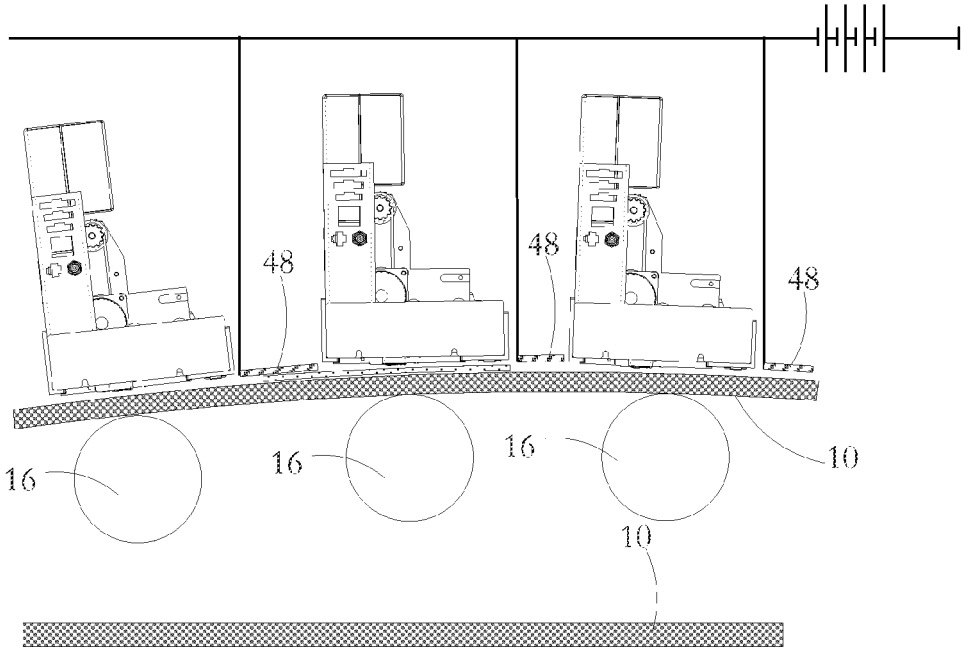
FIG. 6 is a view of a part of the arrangement of FIG. 1 showing another means for inhibiting image deterioration owing to dust attracted towards print heads by the presence of charge on the belt and paper sheets transported by the belt.
Figure 5:
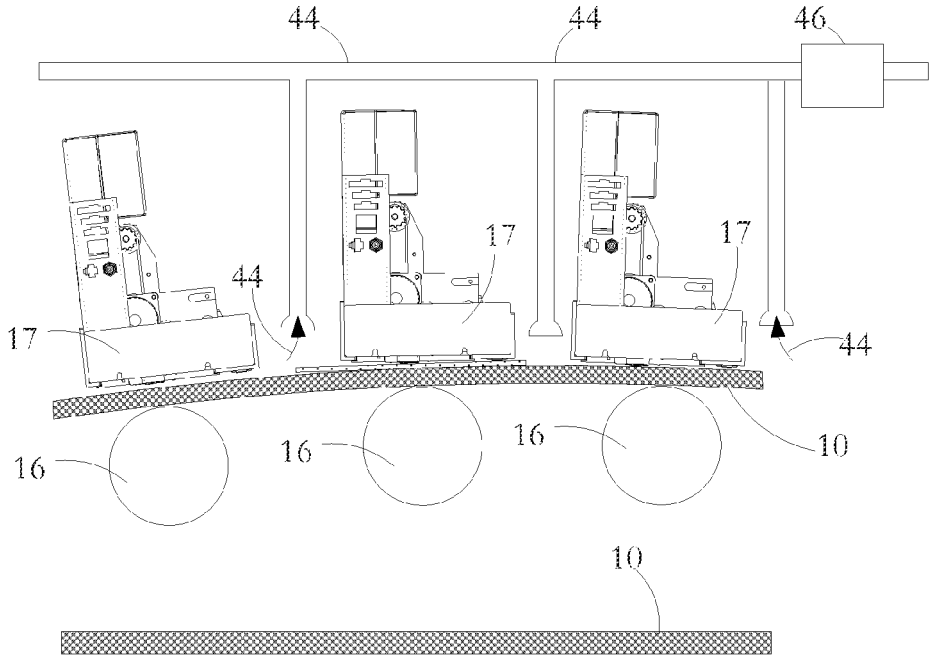
FIG. 5 is a view of a part of the arrangement of FIG. 1 showing one means for inhibiting image deterioration owing to dust attracted towards print heads by the presence of charge on the belt and paper sheets transported by the belt.

For maintaining a clean zone around the print heads, a first method uses, to the extent possible, features of the clean room environment known, for example, from integrated circuit production. In circumstances where a clean room environment is too expensive or otherwise impractical, other methods are used. In one method, a preventative measure is adopted. As previously mentioned, the rollers 16 underlying the belt 10 are held at a negative potential with a voltage sufficient to bring the associated electric field in the region of the print head nozzles to zero. The negative potential neutralizes the field impact of the charged sheets in the region where the ink droplets exit the nozzles and "fly" to the sheets. In one exemplary dust removal technique illustrated in FIG. 5, precisely directed air currents 44 are generated to sweep air-borne dust particles towards filters which are periodically cleaned or replaced. In another method, as shown in FIG. 6, electrodes 48 are positioned at locations where they do not affect the electric field dynamics required to establish the electrostatic tacking, but where they function to attract the dust particles, the attracted dust being periodically removed from the electrodes. The dust particles that are drawn towards charged electrodes are generally not charged positively or negatively, but exist as dipoles. Consequently, a dust electrode 48 attracts one of the poles of a particle. Once attracted, the dust dipole becomes aligned with the electric field produced by the electrode and so the dust particle as a whole is attracted to the dust electrode.

While the sheet paper transfer system of the invention has been described in relation to a series of inkjet print heads, it will be appreciated that the transfer system can be implemented with other print heads such as laser print heads.

Other variations and modifications will be apparent to those skilled in the art. The embodiments of the invention described and illustrated are not intended to be limiting. The principles of the invention contemplate many alternatives having advantages and properties evident in the exemplary embodiments.

What is claimed is:

1. A printing apparatus having a print head, a transport mechanism comprising a continuous belt for transporting a sheet medium supported on and retained substantially in a fixed position relative to the belt during transport by the belt in a transport direction for printing an image thereon by the print head, the belt being at least partially transparent, and at least one through optical sensor positioned to direct a sensing beam through the belt for sensing the position of the transported sheet medium supported on the belt upon the sheet medium breaking the beam.

2. A printing apparatus as claimed in claim 1, the optical sensor comprising a source and a detector, the source located on one side of the belt, the detector located on the other side of the belt.

3. A printing apparatus as claimed in claim 2, the belt extending horizontally, the source and the detector vertically aligned.

4. A printing apparatus as claimed in claim 1, the source and the detector located on the same side of the belt with the source located laterally adjacent or downstream of the detector in the transport direction, a beam reflector located on the other side of the belt for directing a light beam sent by the source and passing through the belt to the reflector back through the belt to the detector when the light beam from the source is not broken by the presence of a sheet medium, the source positioned to direct said sent light beam generally perpendicularly through the belt, the detector configured to direct the reflected light beam generally perpendicularly through the belt.

5. A printing apparatus as claimed in claim 1, having a plurality of such print heads spaced from one another in a transport direction, the transport mechanism operable to transport a sheet medium tacked to the belt in the transport direction for printing partial images thereon successively by the respective print heads, at least some of the print heads having a respective through optical sensor associated therewith.

6. A printing apparatus as claimed in claim 5, at least one of the through beam sensors having one of a source and a detector of the through optical sensor mounted on the print head.

7. A printing apparatus as claimed in claim 1, the at least one optical though sensor being a sheet medium launch detector for detecting a leading edge of the sheet medium as it is launched onto the belt, the optical through beam sensor having a first signal output, the apparatus further comprising a measuring device for measuring the movement of the belt in the transport direction, the measuring device having a second signal output, and a signal processing device for processing the signals from the optical through beam sensor and the measuring device to derive the position of a sheet medium transported by the belt.

8. A printing apparatus as claimed in claim 7, the belt driven by a pulley system including a drive shaft, the measuring device including a shaft encoder for measuring rotations of the drive shaft.

9. A printing apparatus as claimed in claim 1, the optical through beam sensors each having an output signal, and a signal processing circuit to process the output signals to determine an instance of a sheet medium transported by the belt not being detected by one of the optical through beam sensors when, as a result of prior monitoring of the sheet medium position and the measuring of the movement of the belt, the sheet medium is expected to be detected by such optical through beam sensor.

10. A printing apparatus as claimed in claim 1, having a plurality of such optical through beam sensors extending transversely of the transport direction.

11. A printing apparatus as claimed in claim 10, the transversely extending optical through beam sensors having output signals, and a signal processing circuit to detect the signals from the transversely extending optical sensors and to identify skew in the position of a sheet medium in relation to the belt.

12. A method of sensing a sheet medium that is supported on, and retained substantially in a fixed position relative to, a continuous belt transporting the sheet medium in a transport direction past a print head for printing on the sheet medium, the belt being at least partially transparent, the method comprising directing a sensing beam of an optical through beam sensor through the belt and detecting the position of the sheet medium by detecting when a leading edge of the sheet medium supported on the belt breaks the sensing beam.

13. A method as claimed in claim 12, further comprising directing the sensing beam from an optical source located on one side of the belt through the belt to a detector located on the other side of the belt.

14. A method as claimed in claim 12, further comprising directing the sensing beam from an optical source located on one side of the belt though the belt to a reflector located on the other side of the belt, reflecting the sensing beam from the reflector back through the belt to a detector located on said one side of the belt upstream of the optical source, the sensing beam being directed generally perpendicularly through the belt, the reflected light beam being reflected generally perpendicularly through the belt.

15. A method as claimed in claim 12, further comprising transporting the sheet medium retained at the belt in the transport direction past a plurality of print heads spaced from one another in a transp ort direction for printing partial images thereon successively by the respective print heads, at least some of the print heads having a respective through optical sensor associated therewith, and operating the optical sensors to track the position of the sheet medium during its transport past the print heads.

16. A method as claimed in claim 15, further comprising operating at least one of the optical sensors to send a sensing beam from an optical source located on one side of the belt through the belt to a detector located on the other side of the belt.

17. A method as claimed in claim 15, further comprising operating one of the sensors to detect a leading edge of the sheet medium as it is launched onto the belt thereby to produce a first signal output from said optical through beam sensor related to a detected leading edge of the sheet medium, operating a measuring device for measuring the movement of the belt in the transport direction to produce a second signal output from the measuring device related to the position of the belt, and processing the first and second signal outputs to derive the position of the sheet medium transported by the belt.

18. A method as claimed in claim 15, further comprising operating the optical through beam sensors to produce respective output signals and processing the output signals to determine an instance of a sheet medium transported by the belt not being detected by one of the optical through beam sensors when, as a result of prior monitoring of the sheet medium position and the measuring of the movement of the belt, the sheet medium is expected to be detected by such optical through beam sensor.

19. A method as claimed in claim 12, further comprising operating a plurality of the optical through beam sensors extending transversely of the transport direction to produce a respective plurality of output signals, and processing the output signals to identify skew in the position of a sheet medium in relation to the belt.

* * * * *